US011680510B1

(12) United States Patent
Takagi et al.

(10) Patent No.: US 11,680,510 B1
(45) Date of Patent: Jun. 20, 2023

(54) COOLING DEVICE FOR INTERNAL COMBUSTION ENGINE AND COOLING METHOD OF INTERNAL COMBUSTION ENGINE

(71) Applicants: TOYOTA JIDOSHA KABUSHIKI KAISHA, Toyota (JP); AISIN CORPORATION, Kariya (JP)

(72) Inventors: Noboru Takagi, Toyota (JP); Shoichi Akiyama, Toyota (JP); Hirokazu Tanaka, Kariya (JP); Masazumi Yoshida, Kariya (JP); Ryusuke Sasaki, Kariya (JP); Masahiro Kuroki, Kariya (JP); Koki Fukuta, Kariya (JP)

(73) Assignees: TOYOTA JIDOSHA KABUSHIKI KAISHA, Toyota (JP); AISIN CORPORATION, Kariya (JP)

( * ) Notice: Subject to any disclaimer, the term of this patent is extended or adjusted under 35 U.S.C. 154(b) by 0 days.

(21) Appl. No.: 18/061,006

(22) Filed: Dec. 2, 2022

(30) Foreign Application Priority Data

Dec. 28, 2021 (JP) ..... JP2021-214435

(51) Int. Cl.
*F01P 5/10* (2006.01)
*F01P 7/16* (2006.01)
*F01P 3/18* (2006.01)

(52) U.S. Cl.
CPC ..... *F01P 5/10* (2013.01); *F01P 3/18* (2013.01); *F01P 7/162* (2013.01); *F01P 7/164* (2013.01); *F01P 7/165* (2013.01); *F01P 2005/105* (2013.01)

(58) Field of Classification Search
CPC ..... F01P 5/10; F01P 3/18; F01P 2005/105; F01P 7/162; F01P 7/164; F01P 7/165
See application file for complete search history.

(56) References Cited

U.S. PATENT DOCUMENTS

2006/0096553 A1* 5/2006 Takahashi ..... F01P 7/165 123/41.1
2017/0253104 A1* 9/2017 Amano ..... B60H 1/00314
2021/0316591 A1* 10/2021 Kim ..... F25B 21/04

FOREIGN PATENT DOCUMENTS

JP 2011-169237 A 9/2011

* cited by examiner

*Primary Examiner* — Jacob M Amick
(74) *Attorney, Agent, or Firm* — Oblon, McClelland, Maier & Neustadt, L.L.P.

(57) ABSTRACT

A cooling device for an internal combustion engine is provided. The cooling device includes a first passage connected to the internal combustion engine and circulating a coolant, a second passage connected to the internal combustion engine and circulating the coolant, a heat exchanger provided on the first passage and configured such that heat exchange is performed with respect to the coolant, a first pump provided on the first passage, a second pump provided on the second passage and an electronic control unit controlling the first pump and the second pump. The electronic control unit, when a temperature of the coolant is no lower than a predetermined temperature, drives the first pump such that a flow rate of the coolant in the first passage increases as compared to when the temperature of the coolant is lower than the predetermined temperature, and performs first control of stopping the second pump.

8 Claims, 3 Drawing Sheets

COOLING DEVICE FOR INTERNAL COMBUSTION ENGINE AND COOLING METHOD OF INTERNAL COMBUSTION ENGINE

CROSS-REFERENCE TO RELATED APPLICATION

This application claims priority to Japanese Patent Application No. 2021-214435 filed on Dec. 28, 2021, incorporated herein by reference in its entirety.

BACKGROUND

1. Technical Field

The disclosure relates to a cooling device for an internal combustion engine and a cooling method of the internal combustion engine.

2. Description of Related Art

Cooling devices are installed in vehicles, to cool internal combustion engines. Cooling devices include a coolant passage for circulating a coolant, a pump, a heat exchanger (radiator), and so forth. There is disclosed a device in which two coolant passages are connected to an internal combustion engine, and a pump is provided on each coolant passage (e.g., Japanese Unexamined Patent Application Publication No. 2011-169237 (JP 2011-169237 A)).

SUMMARY

The coolant flowing through the two coolant passages may mutually interfere, which can lead to increased pressure loss with respect to the pumps. Increase in pressure loss obstructs the flow of coolant, and cooling performance deteriorates.

The disclosure provides a cooling device for an internal combustion engine and a cooling method of the internal combustion engine, capable of improving cooling performance.

A first aspect of the disclosure relates to a cooling device for an internal combustion engine, the cooling device including a first passage, a second passage, a heat exchanger, a first pump, a second pump, and an electronic control unit. The first passage is connected to the internal combustion engine and is configured to circulate a coolant. The second passage is connected to the internal combustion engine and is configured to circulate the coolant. The heat exchanger is provided on the first passage and is configured such that heat exchange is performed with respect to the coolant. The first pump is provided on the first passage. The second pump is provided on the second passage. The electronic control unit is configured to control the first pump and the second pump. The electronic control unit is configured to, when a temperature of the coolant is no lower than a predetermined temperature, drive the first pump such that a flow rate of the coolant in the first passage increases as compared to when the temperature of the coolant is lower than the predetermined temperature, and perform first control of stopping the second pump.

In the cooling device of the above first aspect, the electronic control unit may be configured to set a rotation speed of the first pump to a maximum rotation speed in the first control.

In the cooling device of the first aspect, the electronic control unit may be configured to, when the internal combustion engine performs a transient operation from a low load to a high load, drive the first pump such that the flow rate of the coolant in the first passage increases as compared to when the transient operation is not performed, and perform second control of driving the second pump such that the flow rate of the coolant in the second passage increases.

In the cooling device having the above configuration, the electronic control unit may be configured to, when an amount in increase of an intake air amount of the internal combustion engine is no less than a predetermined amount, perform the second control.

In the cooling device having the above configuration, the electronic control unit may be configured to, when an amount in increase of an accelerator operation amount of the internal combustion engine is no less than a predetermined amount, perform the second control.

In the cooling device having the above configuration, the electronic control unit may be configured to, when the second control continues for a predetermined time or longer, stop the second control.

In the cooling device of the above first aspect, the first passage and the second passage may partially share a passage, the first pump may be provided on an upstream side of the shared passage on the first passage, and the second pump may be provided on an upstream side of the shared passage on the second passage.

A second aspect of the disclosure relates to a cooling method of an internal combustion engine. Herein, a first passage configured to circulate a coolant is connected to the internal combustion engine. A second passage configured to circulate the coolant is connected to the internal combustion engine. A heat exchanger configured such that heat exchange is performed with respect to the coolant is provided on the first passage. A first pump is provided on the first passage. A second pump is provided on the second passage. The cooling method includes (i) driving the first pump, when a temperature of the coolant is no lower than a predetermined temperature, such that a flow rate of the coolant in the first passage increases as compared to when the temperature of the coolant is lower than the predetermined temperature, and (ii) stopping the second pump, when the temperature of the coolant is no lower than the predetermined temperature.

According to the cooling device for the internal combustion engine in the first aspect and the cooling method of the cooling device for the internal combustion engine in the second aspect as described above, the flow rate of the coolant flowing into the internal combustion engine increases, and the coolant is introduced into the internal combustion engine at a great flow speed, and accordingly the cooling performance of the internal combustion engine can be improved.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
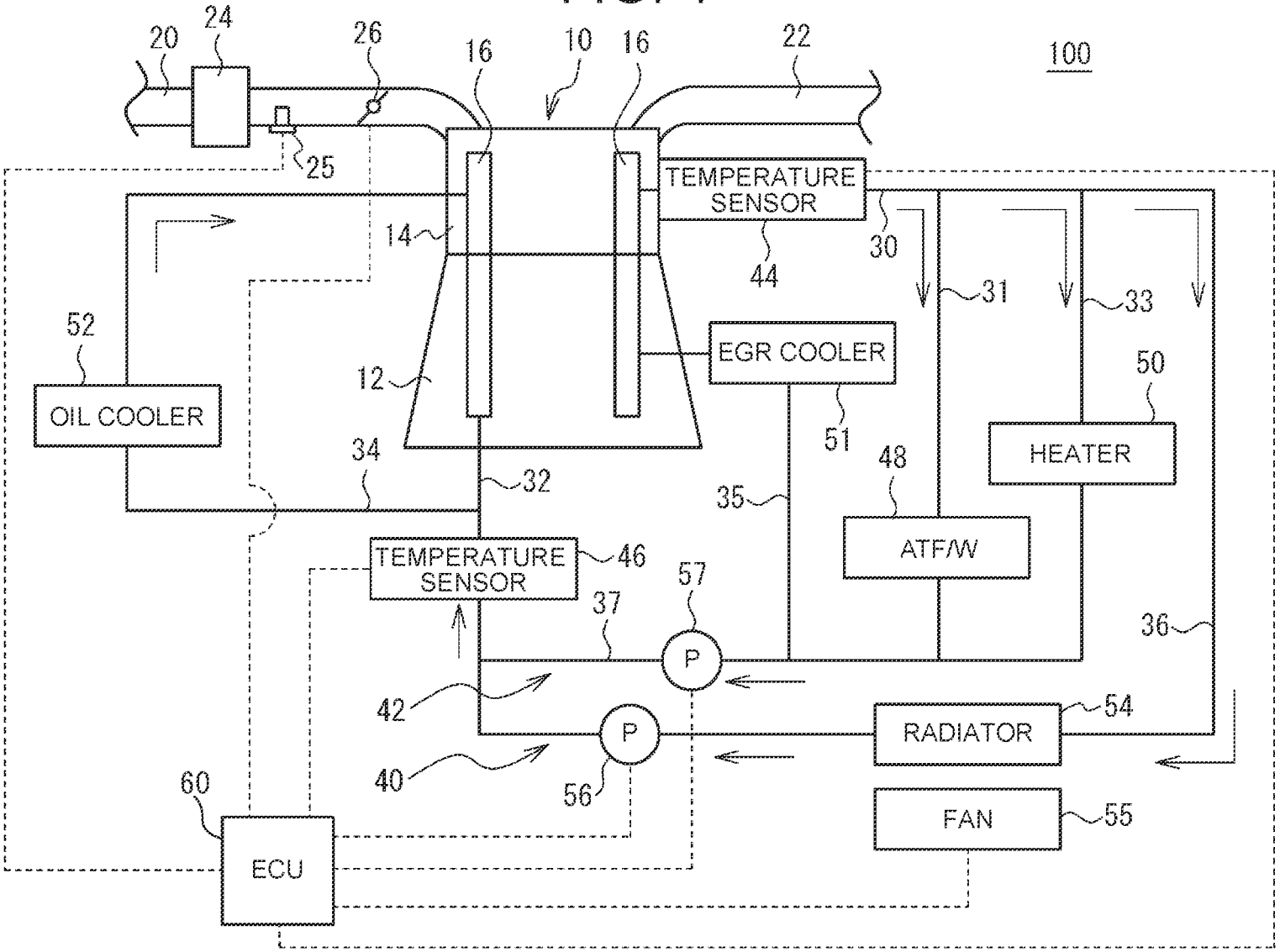
FIG. 1 is a schematic diagram of a cooling device for an internal combustion engine, as an example of the disclosure.

A cooling device for an internal combustion engine according to an embodiment will be described below with reference to the drawings. FIG. 1 is a schematic diagram exemplifying a cooling device 100. The cooling device 100 is installed in a vehicle, and cools an internal combustion engine 10. The internal combustion engine 10 is, for example, a gasoline engine or the like, and has a cylinder block 12 and a cylinder head 14.

The cylinder block 12 and the cylinder head 14 are made of a metal such as an aluminum alloy, for example. The cylinder head 14 is mounted on the cylinder block 12. A combustion chamber is provided in the cylinder head 14. The internal combustion engine 10 has a water jacket 16. The water jacket 16 extends to the cylinder block 12 and the cylinder head 14, surrounds the combustion chamber, and has coolant stored therein.

An intake passage 20 and an exhaust passage 22 are connected to the cylinder head 14 of the internal combustion engine 10. The intake passage 20 is provided with an air cleaner 24, an air flow meter 25, and a throttle valve 26, in this order, from an upstream side to a downstream side. The air cleaner 24 cleans the air. The air flow meter 25 detects the flow rate of air. The throttle valve 26 regulates the flow rate of air. The air flow rate increases as the opening degree of the throttle valve 26 increases. The flow rate decreases as the opening degree decreases. The exhaust passage 22 is provided with parts to control exhaust, such as a catalyst that is omitted from illustration.

Air is introduced into the internal combustion engine 10 through the intake passage 20. Fuel, such as gasoline, is supplied from a fuel injection valve that is omitted from illustration. Power is generated by combustion of an air-fuel mixture of air and fuel in the combustion chamber of the internal combustion engine 10. Exhaust gas generated by the combustion is discharged from the exhaust passage 22. Part of the exhaust gas circulates to the intake passage 20 through an exhaust gas recirculation (EGR) device that is omitted from illustration.

The cooling device 100 has a plurality of coolant passages. Coolant passages 30, 32, 34, and 35 are connected to the water jacket 16. Coolant passages 31, 33, and 36 branch from the coolant passage 30. The coolant passages 31, 33, and 35 merge to provide a coolant passage 37. The coolant passage 36 and the coolant passage 37 merge to provide the coolant passage 32. The coolant passage 34 branches away partway along the coolant passage 32.

The coolant passages 30, 36, and 32 constitute a first passage 40 through which the coolant circulates. The coolant passages 30, 31, 33, 37, and 32 constitute a second passage 42 through which the coolant circulates. The coolant is supplied to the internal combustion engine 10 and is stored in the water jacket 16 to cool the internal combustion engine 10. The coolant is discharged from the internal combustion engine 10, exchanges heat at parts and so forth which will be described later, and is supplied to the internal combustion engine 10 again.

A connection portion between the internal combustion engine 10 and the coolant passage 30 is an outlet for the coolant. A temperature sensor 44 is provided at the connection portion between the coolant passage 30 and the internal combustion engine 10. The temperature sensor 44 detects the temperature of the coolant at an outlet portion from the internal combustion engine 10. A connection portion between the internal combustion engine 10 and the coolant passage 32 is an inlet for the coolant. A temperature sensor 46 is provided further on an upstream side of the coolant passage 32 than the connection portion to the coolant passage 34. The temperature sensor 46 detects the temperature of the coolant at the inlet portion to the internal combustion engine 10.

An automatic transmission fluid heat exchanger (ATF/W) 48 is provided on the coolant passage 31. A heater 50 is provided on the coolant passage 33. An EGR cooler 51 is provided on the coolant passage 35. An oil cooler 52 is provided on the coolant passage 34. The coolant is supplied to the above parts for heat exchange. A pump 57 (second pump) is provided on the coolant passage 37.

The coolant passage 36 is provided with a radiator 54 (heat exchanger) and a pump 56 (first pump). The radiator 54 is a heat exchanger made of a metal such as an aluminum alloy, for example. The coolant is introduced into the radiator 54, and cooled in the radiator 54. The coolant on the downstream side of the radiator 54 has a lower temperature than the coolant on the upstream side thereof and the coolant within the second passage 42. A fan 55 is disposed in the vicinity of the radiator 54. The fan 55 blows wind on the radiator 54 and cools the radiator 54. The pump 56 is situated on the downstream side of the radiator 54.

An electronic control unit (ECU) 60 (also referred to as "control unit") includes a computing device such as a central processing unit (CPU) and storage devices such as flash memory, read-only memory (ROM) and random-access memory (RAM), and performs various types of control by executing programs stored in the storage devices.

The ECU 60 acquires the flow rate of air from the air flow meter 25, acquires the coolant temperature at the outlet portion from the temperature sensor 44, and acquires the coolant temperature at the inlet portion from the temperature sensor 46. The ECU 60 controls the opening degree of the throttle valve 26. The ECU 60 controls the fan 55.

The ECU 60 controls the pump 56 and the pump 57. As the rotation speed of the pump 56 increases, the flow rate of the coolant in the first passage 40 increases. As the rotation speed of the pump 56 decreases, the flow rate of the coolant in the first passage 40 increases. When the pump 56 stops, the flow of the coolant in the first passage 40 stops. As the rotation speed of the pump 57 increases, the flow rate of the coolant in the second passage 42 increases. As the rotation speed of the pump 57 decreases, the flow rate of the coolant in the second passage 42 decreases. When the pump 57 stops, the flow of the coolant in the second passage 42 stops.

The cooling device 100 has the first passage 40 and the second passage 42 through which coolant circulates. Controlling the flow of the coolant in these two passages in accordance with the operating state of the internal combustion engine 10 enables the cooling performance with respect to the internal combustion engine 10 to be improved.

Figure 2:
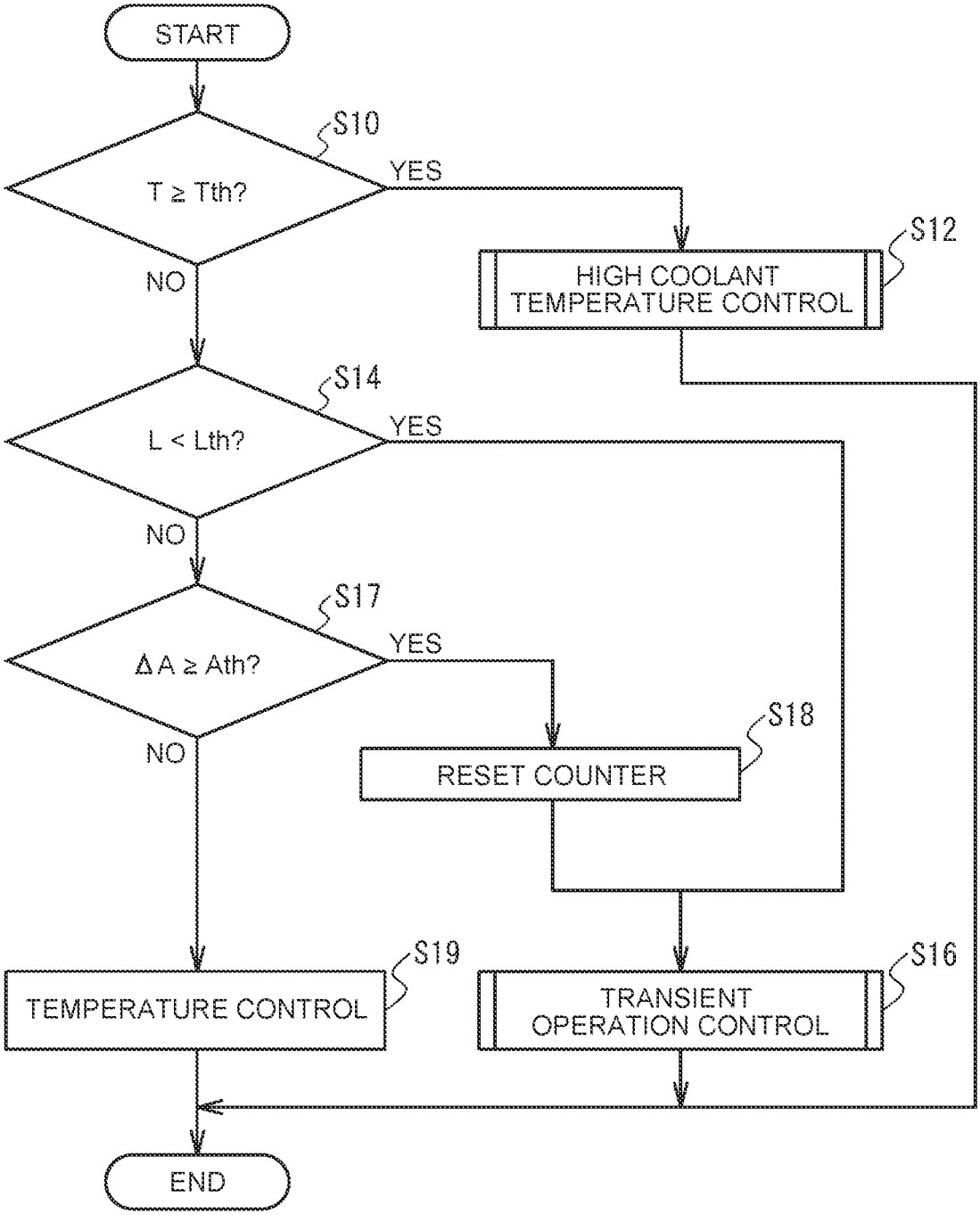
FIG. 2 is a flowchart exemplifying processing executed by an electronic control unit (ECU) illustrated in FIG. 1.

FIG. 2 is a flowchart exemplifying the processing executed by the ECU 60. The ECU 60 acquires a coolant temperature T at the outlet of the internal combustion engine 10 from the temperature sensor 44, and determines whether the coolant temperature T is no lower than a predetermined temperature Tth (step S10). When making a positive determination (Yes), the ECU 60 performs high coolant temperature control (also referred to as "first control") (step S12). High coolant temperature control will be described later. After step S12, the processing of FIG. 2 ends.

When making a negative determination (No) in step S10, the ECU 60 determines whether a duration L of later-described transient operation control is less than a predetermined time Lth (step S14). The time Lth is, for example, in the range of 5 to 20 seconds or the like. When making a positive determination, the ECU 60 continues performing the transient operation control (step S16). Transient operation control will be described later. After step S16, the processing of FIG. 2 ends.

When making a negative determination in step S14, the ECU 60 acquires an intake air amount from the air flow meter 25, and determines whether an increase amount ΔA of the intake air amount within a predetermined time (e.g., within several seconds or the like) is no less than a predetermined value Ath (step S17). When making a positive determination, the ECU 60 resets a counter for measuring the duration L (step S18), and performs transient operation control (also referred to as "second control") (step S16). When making a negative determination, the ECU 60 performs temperature control (step S19). For example, the two pumps 56 and 57 are driven, and the amount of coolant in the first passage 40 and the amount of coolant in the second passage 42 are adjusted, thereby performing temperature control.

Figure 3A:
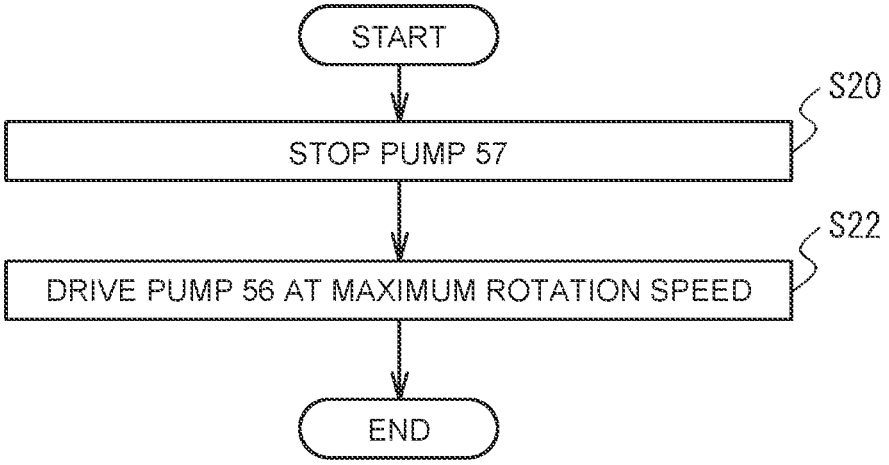
FIG. 3A is a flowchart exemplifying high coolant temperature control by the cooling device.

FIG. 3A is a flowchart exemplifying high coolant temperature control. The ECU 60 stops the pump 57 (step S20). The coolant flow in the second passage 42 stops. The ECU 60 drives the pump 56 at the maximum rotation speed (step S22). After step S22, the processing of FIG. 3A ends.

By driving the pump 56 at the maximum rotation speed, the flow rate of the coolant in the first passage 40 increases, and the supply amount of the coolant to the radiator 54 increases. The pump 57 is stopped, and accordingly interference between the coolant flowing through the coolant passage 36 and the coolant in the coolant passage 37 is suppressed. The pressure loss with respect to the pump 56 is suppressed, and accordingly the flow rate of the coolant in the first passage 40 is effectively increased. Part of the coolant flows from the coolant passage 36 to the coolant passage 37 as well, passes through the coolant passage 36, and is supplied to the radiator 54. Due to the amount of coolant supplied to the radiator 54 increasing, more coolant is cooled by the radiator 54. The cooled coolant is introduced into the internal combustion engine 10. The internal combustion engine 10 can be effectively cooled by high coolant temperature control.

Figure 3B:
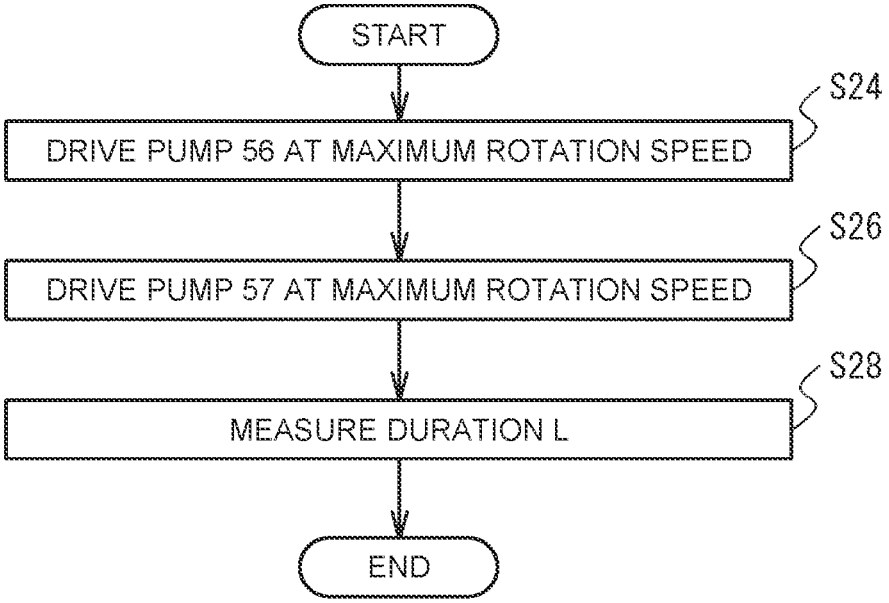
FIG. 3B is a flowchart exemplifying transient operation control of the cooling device.

FIG. 3B is a flowchart exemplifying transient operation control. The term "transient operation" means operation when the internal combustion engine 10 is shifting from a low load to a high load. The ECU 60 drives the pump 56 at the maximum rotation speed (step S24), and also drives the pump 57 at the maximum rotation speed (step S26). The ECU 60 starts the counter, and measures the duration L from the start of the transient operation control (step S28). This completes the processing of FIG. 3B.

By driving the pumps 56 and 57 at the maximum rotation speed, the flow rate of the coolant in the first passage 40 and the second passage 42 increases, and flow speed of the coolant flowing into the internal combustion engine 10 is maximized. Increasing the flow speed improves cooling performance. Responsivity to the internal combustion engine 10 is improved, the internal combustion engine 10 can be cooled rapidly, and temperature rise can be suppressed.

According to the present embodiment, when the temperature T of the coolant is no lower than Tth, the ECU 60 stops the pump 57 and stops the flow of the coolant in the second passage 42, as shown in FIG. 3A. The ECU 60 drives the pump 56 such that the flow rate of the coolant in the first passage 40 increases as compared with states other than the high temperature state (when T<Tth), and circulates the coolant in the first passage 40. The coolant flow in the second passage 42 is stopped, and accordingly the coolant flow in the first passage 40 is less likely to be obstructed. Backflow of coolant from the first passage 40 to the second passage 42 (coolant passage 37) is also allowed. The pressure loss of the pump 56 is suppressed, and the flow of the coolant in the first passage 40 readily increases. The coolant is introduced into the radiator 54, and the coolant is cooled, thereby improving the cooling performance. The coolant after cooling by the radiator 54 is introduced into the internal combustion engine 10, thereby cooling the internal combustion engine 10. The internal combustion engine 10 in a high temperature state can be effectively cooled, and overheating and so forth can be suppressed.

In high coolant temperature control, the ECU 60 preferably increases output of the pump 56 to 90% or more, 95% or more, or the like, and particularly preferably drives the pump 56 at the maximum rotation speed (output 100%) (step S22 in FIG. 3A). The flow rate of the coolant in the first passage 40 increases, and accordingly reduction in temperature of the coolant by the radiator 54 and cooling of the internal combustion engine 10 can be promoted.

The first passage 40 and the second passage 42 share the coolant passage 32. The coolant flow of the first passage 40 and the coolant flow of the second passage 42 merge at the coolant passage 32. When two coolant flows collide, the pressure loss of the pump increases. Stopping the pump 57 stops the coolant flow in the second passage 42. Pressure loss of the pump 56 due to interference of coolant flows is suppressed, and the coolant flow in the first passage 40 can be increased. A greater amount of coolant flows to the radiator 54 and is cooled, and accordingly cooling performance is improved.

When the coolant temperature T is lower than Tth, the risk of overheating is low. However, the temperature of the internal combustion engine 10 tends to rise during transient operation from low-load operation to high-load operation. When the increase amount ΔA of the intake air amount is no less than the predetermined value Ath, the internal combustion engine 10 is in a state of transient operation. At this time, the ECU 60 drives the pumps 56 and 57 such that the flow rates of the coolant in the first passage 40 and the second passage 42 increase (FIG. 3B). The amount of coolant flowing into the internal combustion engine 10 from the first passage 40 and the second passage 42 increases. Introducing the coolant into the internal combustion engine 10 at a high flow speed improves the cooling performance. Rapidly cooling the internal combustion engine 10 can suppress knocking during transient operation. Thus, there is no need to retard the ignition timing or the like to deal with knocking, and accordingly poor fuel mileage, reduced torque, and so forth, are suppressed. The ECU 60 may drive the pumps 56 and 57 at the maximum rotation speed. Effective cooling can be achieved by maximizing the flow rate of the coolant to the internal combustion engine 10.

As described above, performing transient operation control of FIG. 3B improves the responsivity of the cooling device 100, and the internal combustion engine 10 is rapidly cooled. The temperature of the coolant rises following usage for cooling the internal combustion engine 10. The temperature sensor 44 detects the temperature rise of the coolant, and when the temperature is high, the ECU 60 performs the high coolant temperature control shown in FIG. 3A. Priority is given to cooling the coolant by the radiator 54. The internal combustion engine 10 can be cooled by the cooled coolant, and rise in temperature can be suppressed. According to the present embodiment, both improvement in responsivity during transient operation and improvement in cooling performance at high temperatures can be realized.

When the duration L of the transient operation control is Lth or longer, the ECU 60 stops the transient operation control. Thereafter, the ECU 60 can perform the high coolant temperature control shown in FIG. 3A when the temperature is high (T≥Tth). When the temperature is not high (T<Tth), the ECU 60 performs temperature control (step S19 in FIG. 2). The ECU 60 drives both the pumps 56 and 57, controls the respective rotation speeds thereof, and adjusts the flow rate of the coolant in the first passage 40 and the flow rate of the coolant in the second passage. The ECU 60 maintains the temperature of the coolant in an appropriate range. For example, when the temperature of the coolant rises to a predetermined temperature or higher, the rotation speed of the pump 56 is increased, and the flow rate of the coolant in the first passage 40 is increased. The amount of coolant cooled by the radiator 54 increases. When the temperature of the coolant falls to a predetermined temperature or lower, the rotation speed of the pump 56 is lowered, and the amount of coolant cooled by the radiator 54 is reduced.

As shown in FIG. 2, whether to perform high coolant temperature control is determined based on the temperature of the coolant at the outlet portion of the internal combustion engine 10, detected by the temperature sensor 44. In addition to the water temperature detected by the temperature sensor 44, the coolant temperature of the inlet portion detected by the temperature sensor 46 may also be used for judgment. Besides increase in the amount of intake air, when an increase in an amount of depression of an accelerator pedal (accelerator operation amount) that is omitted from illustration is no less than a predetermined amount or the like, for example, this may be used for judgment regarding transient operation.

Although a preferred embodiment of the disclosure has been described in detail above, the disclosure is not limited to a specific embodiment, and various modifications and variations can be made without departing from the scope of the disclosure set forth in the Claims.

What is claimed is:

1. A cooling device for an internal combustion engine, the cooling device comprising:

a first passage that is connected to the internal combustion engine and that is configured to circulate a coolant;

a second passage that is connected to the internal combustion engine and that is configured to circulate the coolant;

a heat exchanger that is provided on the first passage and that is configured such that heat exchange is performed with respect to the coolant;

a first pump provided on the first passage;

a second pump provided on the second passage; and an electronic control unit configured to control the first pump and the second pump, wherein the electronic control unit is configured to, when a temperature of the coolant is no lower than a predetermined temperature, drive the first pump such that a flow rate of the coolant in the first passage increases as compared when the temperature of the coolant is lower than the predetermined temperature, and perform first control of stopping the second pump.

2. The cooling device according to claim 1, wherein the electronic control unit is configured to set a rotation speed of the first pump to a maximum rotation speed in the first control.

3. The cooling device according to claim 1, wherein:

the electronic control unit is configured to, when the internal combustion engine performs a transient operation from a low load to a high load, drive the first pump such that the flow rate of the coolant in the first passage increases as compared to when the transient operation is not performed; and the electronic control unit is configured to, when the internal combustion engine performs the transient operation from a low load to a high load, perform second control of driving the second pump such that the flow rate of the coolant in the second passage increases.

4. The cooling device according to claim 3, wherein the electronic control unit is configured to, when an amount in increase of an intake air amount of the internal combustion engine is no less than a predetermined amount, perform the second control.

5. The cooling device according to claim 3, wherein the electronic control unit is configured to, when an amount in increase of an accelerator operation amount of the internal combustion engine is no less than a predetermined amount, perform the second control.

6. The cooling device according to claim 3, wherein the electronic control unit is configured to, when the second control continues for a predetermined time or longer, stop the second control.

7. The cooling device according to claim 1, wherein:

the first passage and the second passage partially share a passage;

the first pump is provided on an upstream side of the shared passage on the first passage; and the second pump is provided on the upstream side of the shared passage on the second passage.

8. A cooling method of an internal combustion engine, wherein a first passage configured to circulate a coolant is connected to the internal combustion engine, a second passage configured to circulate a coolant is connected to the internal combustion engine, a heat exchanger configured such that heat exchange is performed with respect to the coolant is provided on the first passage, a first pump is provided on the first passage, and a second pump is provided on the second passage, the cooling method comprising:

driving the first pump, when a temperature of the coolant is no lower than a predetermined temperature, such that a flow rate of the coolant in the first passage increases as compared to when the temperature of the coolant is lower than the predetermined temperature; and stopping the second pump when the temperature of the coolant is no lower than the predetermined temperature.

* * * * *